United States Patent [19]

Kahn

[11] Patent Number: 5,023,909

[45] Date of Patent: Jun. 11, 1991

[54] MULTI-SYSTEM AM STEREO RECEIVER HAVING PREFERRED MODE OF OPERATION

[76] Inventor: Leonard R. Kahn, 137 E. 36th St., Apt. 6A, New York, N.Y. 10016

[21] Appl. No.: 412,035

[22] Filed: Sep. 25, 1989

[51] Int. Cl.[5] ..... H04H 5/00

[52] U.S. Cl. ..... 381/15

[58] Field of Search ..... 381/13, 15

[56] References Cited

U.S. PATENT DOCUMENTS 4,653,095 3/1987 Kahn ..... 381/13

*Primary Examiner*—Forester W. Isen

*Attorney, Agent, or Firm*—E. A. Onders

[57] ABSTRACT

Stereo decoders for use in AM stereo receivers are disclosed which have two different modes of operation, one of which suffers adverse effects from the presence of co-channel interference and employs envelope detection to develope an (L+R) representative signal. When such interference is detected the decoder switches to a second mode of operation, which is less affected by the interference, and also switches to synchronous detection to develop the (L+R) representative signal.

3 Claims, 3 Drawing Sheets

MULTI-SYSTEM AM STEREO RECEIVER HAVING PREFERRED MODE OF OPERATION

FIELD OF THE INVENTION

This invention relates to multi-system AM stereo receivers, and, in particular, to the reduction of objectionable effects of co-channel type interference in such receivers.

BACKGROUND OF THE INVENTION

In March 1982 the Federal Communications Commission (FCC) followed the so-called "marketplace approach" to selecting a standard for AM stereo broadcasting and authorized such broadcasting using any of several competing systems. In all of the competing Am stereo systems, the left channel (L) and right channel (R) stereo audio signals are summed to form an L+R signal which is used to amplitude modulate a radio-frequency (RF) carrier in the usual manner.

By subtraction, an L−R signal is also formed which is used in some AM stereo systems to phase modulate (PM) the RF carrier, or, in others to quadrature modulate (QM) the carrier.

The broadcast signals from all AM stereo systems used in the United States are compatible with conventional monaural AM receivers, but are not compatible with each other. That is, an AM stereo receiver designed for one system generally is incompatible with stereo signals broadcast using other systems.

Because of this incompatibility, receiver manufacturers have been faced with the choice of designing stereo receivers for only one AM stereo system, or receivers capable of stereophonic reception of signals of more than one of the systems. Both types of receivers have appeared in the marketplace, and multiple-system receivers have been of two general types. Some have included pilot-signal detection circuits which have provided automatic switching of those receiver circuits required to properly decode the AM stereo signal being received. Other multiple-system receivers have been equipped with manual switches for that purpose.

As used herein the term "co-channel type interference" refers to co-channel interference and interference having similar characteristics, such as might be caused by selective fading or skywave/groundwave interaction.

The degree of annoyance of the adverse effects produced in a multi-system AM stereo receiver by the presence of co-channel type interference is not the same for all AM stereo systems. For example, if the interference occurs when the receiver's AM stereo decoder circuits are operating in the Motorola system mode of reception, which is a phase-separated system, co-channel type interference will produce (in addition to the fluctuations in volume normally experienced in monaural reception) a side-to-side movement of sound sources in the AM stereo image, which movement has come to be known as stereo "platform motion". Under certain conditions of interference, sound sources in the stereo image will swing back and forth, from full left to full right, in synchronism with the co-channel beat frequency, i.e. the difference in carrier frequencies of the desired and interfering signals.

However, when the receiver is operating in the Kahn/Hazeltine system mode of reception, platform motion does not occur because the Kahn/Hazeltine system is an independent sideband (ISB) or frequency-separated AM stereo system. With the Motorola modes of reception, platform motion is an inherent characteristic of the receiver design imposed by the nature of this AM stereo system. In brief, the reasons this system is subject to platform motion, whereas the Kahn/Hazeltine system is not, are as follows.

The Kahn/Hazeltine ISB AM stereo system is essentially a frequency-separated system, i.e. in the transmitted signal, left stereo information is carried essentially single sideband in the lower-frequency sidebands, and right stereo information is carried in the upper-frequency sidebands. On the other hand, in the Motorola system, as well as other phase-separated systems such as the Magnavox system, the stereo information exists in the carrier phase modulation and cannot be separated out by frequency from the double sideband signal. Thus, the Motorola AM stereo system is inherently a phase-separated system and, therefore, is critically sensitive to any interference (such as co-channel) or other disturbances which alter the phase of the broadcast signal before it is decoded in the receiver.

The Kahn/Hazeltine system, on the other hand, being frequency separated, is relatively immune to spurious phase variations in the signal, such as those produced by an undesired co-channel signal interacting with the desired signal in the receiver.

It is, therefore, an object of the invention to provide the capability in an AM stereo receiver to automatically switch the receiver to the Kahn/Hazeltine system mode of reception, if it is not already in that mode, when objectionable co-channel type interference is present, regardless of the type of AM stereo signal being received at the time. If the signal being received is the signal of a phase-separated AM stereo system, such as the Motorola system, the objectionable stereo platform motion which would otherwise be present in the reproduced stereo image will be eliminated by switching the receiver to the Kahn/Hazeltine system mode of reception. While stereo separation will be adversely affected by switching the receiver to the Kahn/Hazeltine mode of reception when receiving a phase-separated stereo system signal, the net effect to the listener will be a significant improvement due to the elimination of platform motion. Furthermore, a "fullness" or ambiance of the sound image will still exist, and it has long been recognized that this "fullness" of sound in a stereo-sound image is of great importance. In fact it has been deemed by some to be of greater importance to the listener than the directional characteristics, as noted in a paper, "The Non-Directional Aspect of Stereo", by C. J. Hirsch and published in the November 1961 issue of the IRE Transactions of Broadcast and Television Receivers, Vol. BTR-7, No. 3, pp. 36–39.

Some prior art AM stereo receivers for phase-separated systems have "solved" the problem caused by co-channel type interference by using a detector which automatically switches the receiver to monaural reception in the presence of co-channel type interference, thereby losing all benefit of stereo reception. However, in contrast with this, the present invention eliminates the platform motion effects of co-channel type interference while retaining desirable ambiance in the reproduced stereo image.

A further object of the invention is to reduce distortion effects which will occur when co-channel type interference is present in an AM receiver. The interaction of the interfering signal with the desired signal in the receiver produces an effect similar to selective fading. Selective fading is defined in the IEEE Standard Dictionary of Electrical and Electronic Terms, ANSI-IEEE Std. 100-1984, Aug. 10, 1984 edition, p. 812, as "Fading that is different at different frequencies in a frequency band occupied by a modulated wave". Consequently, when co-channel type interference is present in an AM receiver, the audio signal recovered by an envelope detector in the receiver will be distorted. The distortion in the output of a synchronous detector under the same interfering conditions will be significantly less. Since it is common practice in receivers for current AM stereo systems to employ envelope detectors to recover the L+R component of the stereo signal, the invention provides automatic switching of the receiver from envelope detection of the L+R signal to synchronous detection when co-channel type interference is present, thereby reducing distortion.

SUMMARY OF THE INVENTION

In accordance with one aspect of the present invention, there is provided an improved AM stereo receiver for AM stereo signals which have been generated in accordance with a selected AM stereo system and which are adversely affected by co-channel type interference. The receiver includes means for receiving radio-frequency (RF) AM stereo signals and for converting the signals to a corresponding intermediate-frequency (IF) signal. Such receiver also includes means for detecting the presence of co-channel type interference in the received signal and for developing a control signal indicative thereof. Such receiver also includes decoding means for decoding, responsive to said IF signal and to said control signal and capable of at least two different modes of stereo signal decoding, for decoding received AM stereo signals in a first stereo mode which suffers adverse effects from the presence of co-channel type interference, and for switching to a second stereo mode when the presence of co-channel type interference is indicated by said control signal, said second mode being less adversely affected by co-channel type interference.

In accordance with another aspect of the invention, there is provided in an AM receiver apparatus for reducing distortion otherwise produced in the output of said receiver in the presence of co-channel type interference. Said receiver includes means for supplying an intermediate-frequency (IF) signal representative of radio-frequency (RF) signals received by said receiver. Such receiver also includes means for detecting the presence of co-channel type interference in said IF signal and for developing a control signal indicative thereof. Such receiver also includes demodulating means, responsive to said IF signal and to said control signal and capable of two different modes of amplitude demodulation, the first of which uses envelope detection of said IF signal and the second of which uses synchronous detection, for amplitude demodulating said IF signal in said first mode and for switching to said second mode when the presence of co-channel type interference is indicated by said control signal, thereby reducing the distortion otherwise present in the output of said demodulating means in the presence of co-channel type interference.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
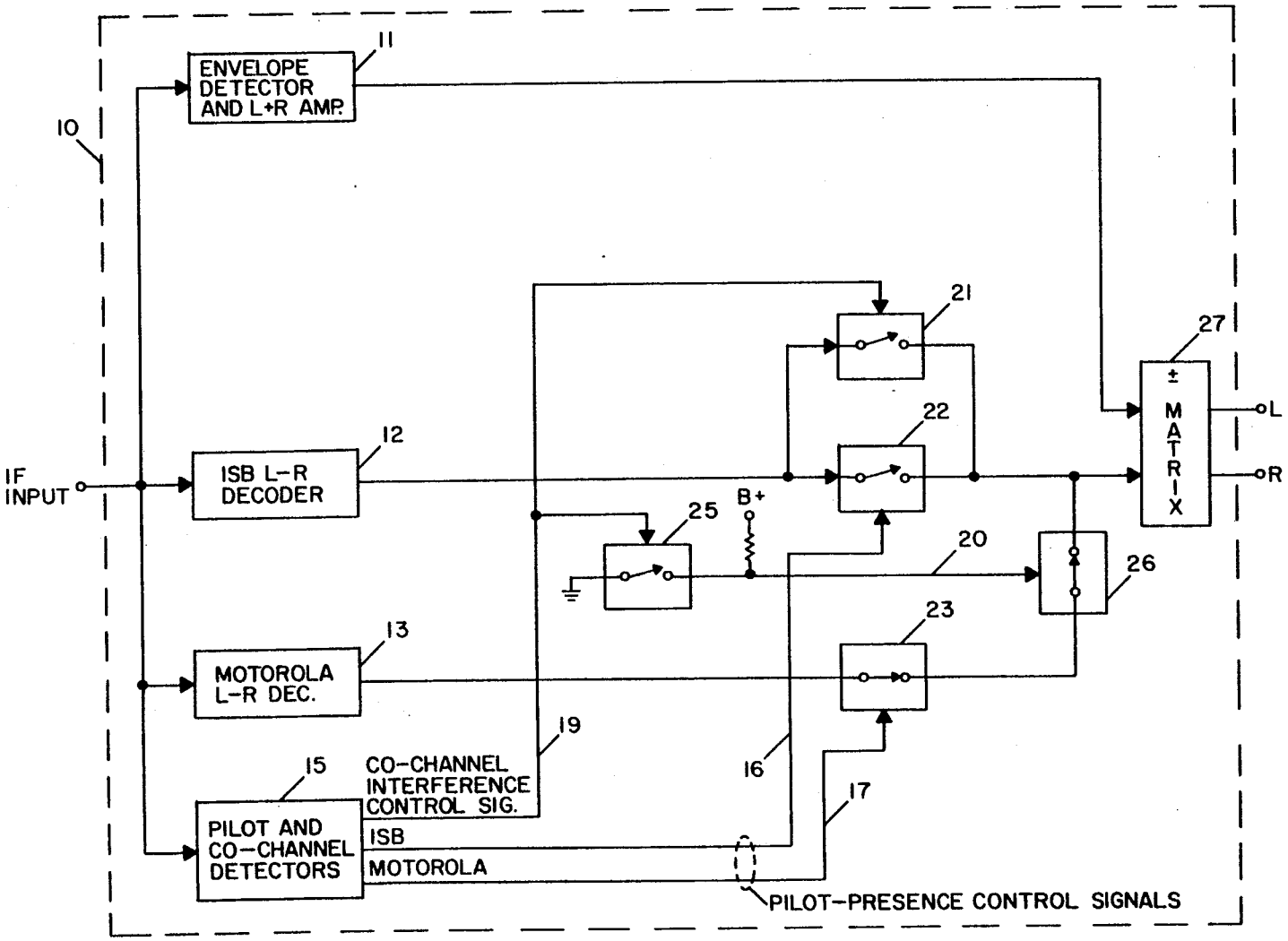
FIG. 1 shows a functional block diagram of the decoder portion of a multi-system AM stereo receiver, embodying the invention in one form, which automatically switches to the Kahn/Hazeltine system mode of reception when co-channel type interference is present.

A functional block diagram of a multi-system AM stereo receiver embodying the invention in one form is shown in FIG. 1. It should be noted that for the sake of clarity in explaining the invention, the diagram is divided into function blocks which do not necessarily represent circuit divisions as they might be found in actual multi-system AM stereo receivers. For example, each of the L−R decoder blocks 12 and 13 in FIG. 1 normally would employ similar (in some cases identical) circuits, such as synchronous detectors and phase-reference signal sources which might, therefore be combined in actual practice. However, the functional divisions in FIG. 1 best illustrate, and are not intended to limit, the invention.

Switches 21 through 23, 25 and 26 in FIG. 1 are shown as electronic switches which are activated by electrical control signals. This type of switch is readily available in integrated-circuit form, such as RCA Type CD4066B quad bilateral switch integrated circuit, for example. However, the invention is not limited to use with this type of switch. The same also applies to the switches shown in FIGS. 2 and 3.

Figure 2:
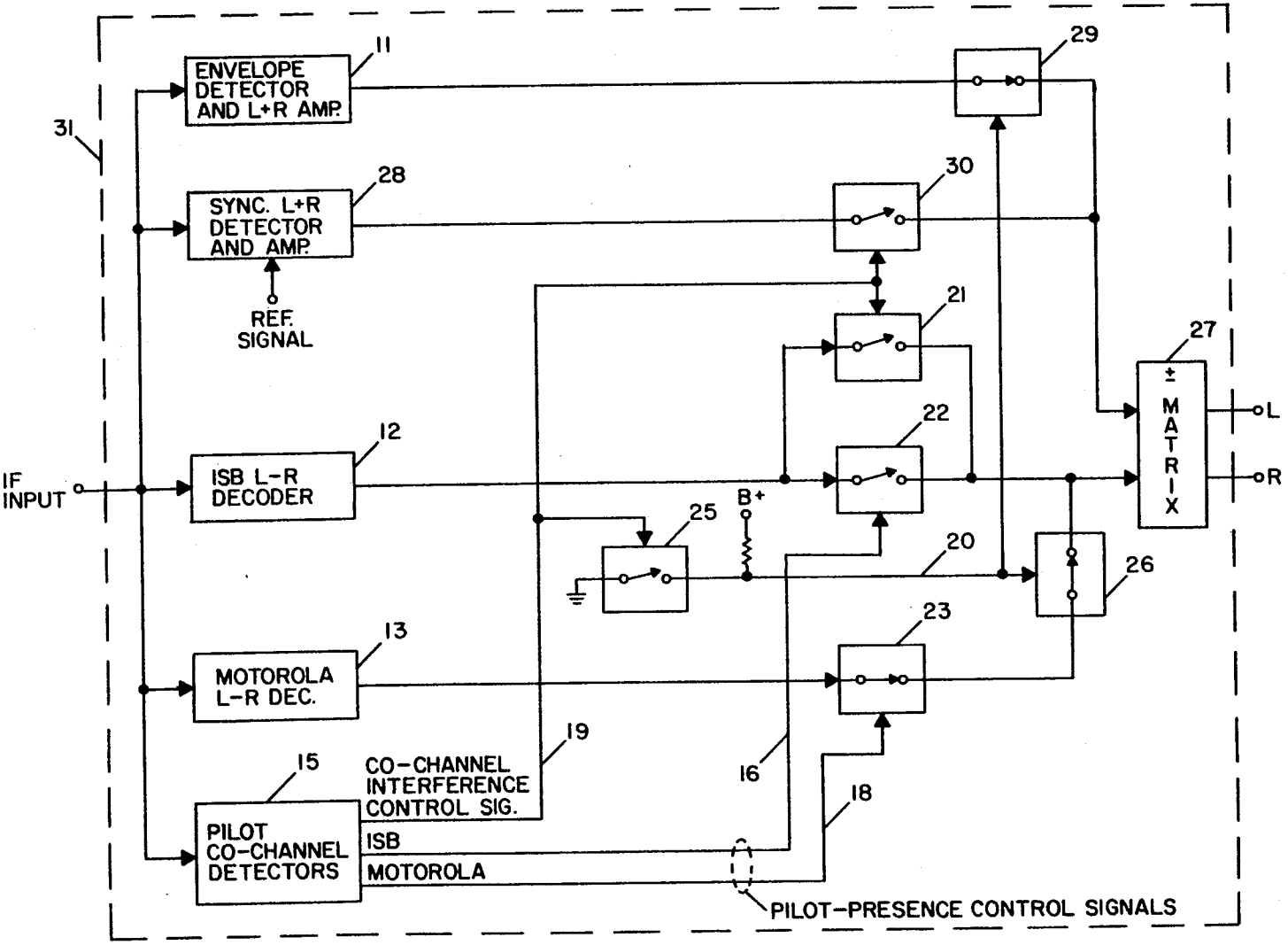
FIG. 2 shows a functional block diagram of the decoder portion of a multi-system AM stereo receiver, embodying the invention in another form, which also automatically switches from L+R envelope detection to synchronous detection when co-channel type interference is present.
Figure 3:
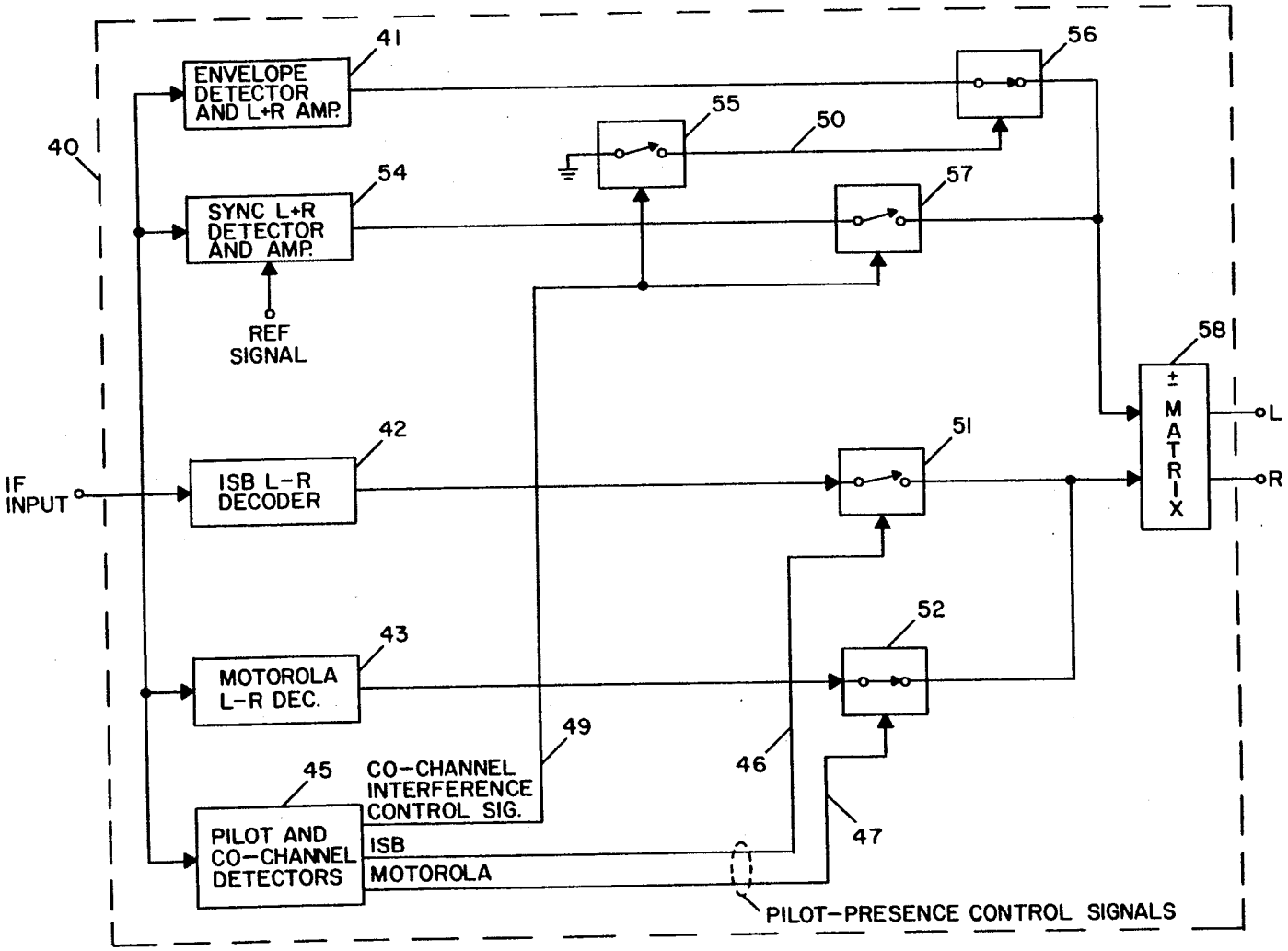
FIG. 3 shows a functional block diagram of the decoder portion of a multi-system AM stereo receiver embodying the invention in yet another form.

In FIG. 1, the IF input to multi-system AM stereo decoder 10 is derived from an RF/IF unit, which, in combination with an antenna, receives radio frequency (RF) signals and converts them to a corresponding intermediate-frequency (IF) signal in a manner well known. The IF input is coupled to envelope detector 11 and also to Kahn/Hazeltine system L−R decoder 12, Motorola system L−R decoder 13 and Magnavox system L−R decoder (not shown). Each of these L−R decoder blocks contains the circuits required for decoding L−R information from the signal of the AM stereo system for which each decoder is designed. Decoder circuit designs for each of these AM stereo systems are well known to those skilled in the art. It should be noted that while FIGS. 1, 2, and 3 show decoders for only three of the known types of AM stereo systems, decoders for other types of AM stereo systems may be added, or substituted, within the scope of the invention.

Matrix 27 adds and subtracts the L+R and L−R signals to produce left (L) and right (R) signal outputs which may be coupled to audio amplifiers which drive L and R sound reproducing devices, respectively.

The IF input signal is also shown coupled to the pilot-signal and co-channel type interference detector unit 15. However, again it should be noted that in an actual receiver the output of the phase-detectors in L−R decoders 12 or 13 (or a phase detector common to two or more of the L−R decoders) may provide the input to the pilot and co-channel type interference detector circuits in unit 15. Various types of pilot detector circuits are known to those skilled in the art, and an example of a co-channel type interference detector may be found in the Sanyo LA1910 multi-system AM stereo decoder integrated circuit (IC). The Sanyo IC is described in the technical paper entitled "Single Chip Multi-System AM Stereo Decoder IC" published in the IEEE Transactions On Consumer Electronics, August 1986, Vol. CE-32, No. 3 (ISSN 0098-3063), pages 482–495.

Except where noted herein, the co-channel interference detector 15 will be considered to produce an output control signal only when both an AM stereo pilot signal and co-channel type interference are present. If the detector does not inherently have that property, it will be obvious to those skilled in the art that a detector of co-channel type interference in both the absence or presence of an AM stereo pilot signal can be followed by a suitable logic circuit, with an input from the pilot detector circuits, which will provide a co-channel type interference control signal only when an AM stereo pilot signal is also present.

In block 15, when a Kahn/Hazeltine system signal is being received, its associated 15 Hz pilot signal will be detected and a control signal developed and coupled via lead 16 to switches 22. Similarly, when a Motorola system signal is being received, its 25 Hz pilot signal will be detected, and a control signal will be developed and coupled via lead 17 to switch 23. Likewise, when a Magnavox system signal is received its 5 Hz pilot signal will be detected and a control signal will be developed and coupled via a lead to a switch.

When co-channel type interference above a predetermined threshold level is present, a corresponding control signal will be developed by unit 15 and coupled via lead 19 to switches 21 and 25. In FIG. 1 the switches are shown in the positions corresponding to reception of a Motorola AM stereo system signal with no co-channel type interference. However, if, for example, a Kahn-/Hazeltine AM stereo system signal were being received, switch 22 would be closed and switch 23 would be open. All switches shown in FIG. 1, with the exception of switch 26, are normally open, and are caused to close by the control signals which are coupled to them via leads 16 through 19.

If in FIG. 1, co-channel interference is present, the resulting control signal on lead 19 will cause switches 21 and 25 to close. The closing of switch 21 connects the output of Kahn/Hazeltine system L−R decoder 12 to matrix 27. The closing of switch 25 causes switch 26 to open. Thus, in the presence of co-channel type interference, in accordance with the invention, the L−R output of Motorola system decoder 13 is disconnected by switch 26 from the L−R input port of matrix 27, and is replaced, through the closing of switch 21, by the output of Kahn/Hazeltine system L−R decoder 12. As described previously herein, with this arrangement the ambiance of the sound is preserved in the sound image reproduced from the resulting stereo signals developed at the output of matrix 27, but the directional characteristic is essentially lost. However, the elimination of platform motion in the resulting sound image is the principal benefit and produces a more acceptable sound image than if the receiver remained in the Motorola system mode or were switched to the monaural mode of reception.

Similarly, if a Magnavox AM stereo system signal is being received, a switch would be closed and switch 23 would be open. Then, in the presence of co-channel interference the control signal on lead 19 will cause switches 21 and 25 to close, which in turn will cause switch 26 to open. Thus, the output of Magnavox system decoder 15 will be disconnected from matrix 27, and the output of Kahn/Hazeltine system decoder 12 will be connected in its place.

If, in FIG. 1, a Kahn/Hazeltine system signal is being received in the presence of co-channel type interference, switches 21 and 25 will be closed and switch 26 will be opened.

For convenience in explaining the invention, a particular form of switching has been shown in FIG. 1. However, those skilled in the art will recognize that many variations of the switching shown are feasible without departing from the spirit of the invention. An essential feature of the embodiment of the invention shown in FIG. 1 is that the presence of co-channel type interference causes the multi-system AM stereo decoder 10 to function in the Kahn/Hazeltine system mode of reception, regardless of the type of AM stereo signal being received.

FIG. 2 shows a functional block diagram of a multi-system AM stereo decoder 31 which includes the aspect of the invention described in connection with FIG. 1, and also includes an additional aspect described below. The identification and operation of elements 11 through 27 in FIG. 2 are the same as for the correspondingly numbered elements in FIG. 1, just described. FIG. 2 also contains the following additional elements: synchronous L+R detector 28 and switches 29 and 30 which provide further improvement in sound quality in the presence of co-channel type interference. The reference signal input to the synchronous detector in unit 28 may be derived from a phase-locked loop or by other methods well-known to those skilled in the art. As in FIG. 1, the switches of FIG. 2 are shown in positions corresponding to reception of a Motorola AM stereo system signal with no co-channel type interference.

In FIG. 2, when co-channel type interference is present, the resulting control signal on lead 19 causes switches 21 and 25 to close, and switch 26 to open, with the consequences described for FIG. 1. However, additionally, the control signal on lead 20 also causes switch 29 to open, thereby disconnecting the L+R envelope detector 11 output from the L+R input to matrix 27. Also, the control signal on lead 19 is coupled to switch 30, causing it to close and thereby connect the output of the L+R synchronous detector 28 to matrix 27 in place of the L+R envelope detector output from unit 11. This substitution of synchronous L+R detection for envelope detection in the presence of co-channel type interference is another feature of the invention, and results in improved quality of reception in terms of both reduced distortion and improved signal-to-noise ratio, for reception of all types of AM stereo signals.

Again, variations of the switching arrangement shown in FIG. 2 will be apparent to those skilled in the art, and are within the scope of the invention.

FIG. 3 shows a functional block diagram of a multi-system AM stereo decoder 40 embodying only the second aspect of the invention described above in relation to FIG. 2. In FIG. 3, the elements which operate the same as in the FIG. 2 embodiment bear the same reference number.

In the FIG. 3 embodiment, the presence of co-channel type interference does not cause the AM stereo signal decoder to automatically switch to the Kahn/Hazeltine system mode of operation when receiving signals of other AM stereo systems. However, in the same manner as was described for FIG. 2, in the presence of co-channel type interference, the L+R detection is automatically switched from envelope detection to synchronous detection with the resulting advantages that have been described in relation to the FIG. 2 embodiment.

In the embodiments of the invention shown in FIGS. 1, 2, and 3, the switching to the Kahn/Hazeltine system mode of reception, and the switching to synchronous L+R detection will not occur when a monaural signal is being received, since, as described earlier, the co-channel type interference detector 15 does not provide a control-signal output on lead 19 unless both an AM stereo pilot and co-channel type interference are simultaneously present in the received signal.

However, if a co-channel type interference detector which does not require the presence of a pilot signal were used in the embodiment of FIG. 3, then in the presence of co-channel type interference, L+R detection would be switched from envelope detection to synchronous detection for both monaural and stereo modes of reception. Thus, the advantage of synchronous detection in the presence of co-channel type interference would be provided for monaural as well as stereo signal reception. It will be recognized, therefore, that this aspect of the invention may be incorporated in monophonic AM receivers.

Similarly, in FIG. 1, if a co-channel type interference detector not requiring the presence of an AM stereo pilot is used, then in addition to the operation already described for FIG. 1, when receiving a monaural signal in the presence of co-channel type interference the receiver will switch to the Kahn/Hazeltine system mode of reception through the closing of switch 21. In general, when receiving monaural signals in multi-system receivers, the Kahn/Hazeltine system mode of reception is preferred over normal monaural reception because it provides some "fullness" in the resulting sound image without any significant disadvantages.

In the embodiment of FIG. 2, if a co-channel type interference detector which does not require the presence of an AM stereo pilot is used, then in the presence of co-channel type interference the unit will operate as described previously (in the Kahn/Hazeltine system mode) regardless of which type of AM stereo system signal is being received. Additionally, when a monaural signal is received in the presence of co-channel type interference, the control signal on lead 19 will cause decoder 31 to switch to the Kahn/Hazeltine system mode of decoding (if it is not already in that mode) and to synchronous L+R detection in place of envelope detection.

Other embodiments of co-channel type interference protection may be implemented in a multi-system AM stereo decoder of the type shown in FIG. 2. For example, two types of co-channel type interference control signals might be developed; one which requires the presence of an AM stereo pilot; and also one which does not. One way of developing both types would be through the use of a co-channel type interference detector not requiring an AM stereo pilot to produce the first co-channel type interference control signal, followed by a suitable logic circuit which would provide second co-channel type interference control signal only when both a stereo pilot and co-channel type interference are present. This second control signal could be applied via lead 19 in FIG. 2 to switch 21, and a separate output lead, for the first described control signal, could be added between block 15 and switches 25 and 30 in lieu of connecting lead 19 between these units. In this case, performance in the presence of co-channel type interference will be the same as that first described for FIG. 2. Additionally, when receiving a monaural signal with co-channel type interference present, the decoder would remain in the monaural mode, but L+R detection would be switched from envelope to synchronous detection.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An improved stereo decoder, for use in an AM stereo receiver for AM stereo signals which have been generated in accordance with a selected AM stereo system and which are adversely affected by co-channel type interference, comprising:

means for supplying an intermediate-frequency signal corresponding to a received radio-frequency AM stereo signal;

means for detecting the presence of co-channel type interference in said intermediate-frequency signal and for developing a control signal indicative thereof;

and means, responsive to said IF signal and to said control signal and capable of at least two different modes of stereo signal decoding, for decoding received AM stereo signals in a first stereo mode which suffers adverse effects from the presence of co-channel type interference, said first stereo mode using envelope detection to develop a signal representative of stereo sum signal (L+R) information in said intermediate frequency signal, and for switching to a second stereo mode when the presence of co-channel type interference is indicated by said control signal, said second stereo mode using synchronous detection to develop an (L+R) representative signal and being less adversely affected by co-channel type interference.

2. An improved AM stereo receiver in accordance with claim 1 wherein said selected AM stereo system is a phase-separated system, and wherein said decoding means operates in a first stereo decoding mode corresponding to proper decoding for said phase-separated system's signals and wherein said second stereo mode corresponds to decoding appropriate for a frequency-separated AM stereo system.

3. An improved AM stereo receiver in accordance with claim 2 wherein said phase-separated AM stereo system is the Motorola system and said frequency-separated system is the Kahn Hazeltine system.

* * * * *